428-408 SR
PTH49 XR 4,358,046

United States Patent [19]
Detz et al.
[11] 4,358,046
[45] Nov. 9, 1982

[54] ORIENTED GRAPHITE LAYER AND FORMATION

[75] Inventors: Clifford M. Detz; John B. Lightstone, both of White Plains, N.Y.

[73] Assignee: Union Carbide Corporation, Danbury, Conn.

[21] Appl. No.: 778,623

[22] Filed: Mar. 17, 1977

[51] Int. Cl.³ ..... C23C 9/00; F28F 19/02
[52] U.S. Cl. ..... 228/176; 148/6; 148/13.1; 427/227; 427/228; 427/249; 427/374.1
[58] Field of Search ..... 228/176; 427/227, 228, 427/249, 374 R, 383 C; 148/6, 13.1

[56] References Cited

U.S. PATENT DOCUMENTS

| | | | |
|---|---|---|---|
| 2,016,139 | 10/1935 | Eddison | 427/228 |
| 2,167,128 | 7/1939 | Skelton et al. | 148/13.1 |
| 2,294,562 | 9/1942 | Kingston | 427/228 X |
| 3,027,278 | 3/1962 | Reick | 427/228 X |

FOREIGN PATENT DOCUMENTS

| | | | |
|---|---|---|---|
| 47-31862 | 8/1972 | Japan | 427/228 |

OTHER PUBLICATIONS

Derbyshire et al., *Carbon,* vol. 13, (1975), pp. 111–113.

*Primary Examiner*—Kenneth J. Ramsey
*Attorney, Agent, or Firm*—Alvin H. Fritschler

[57] ABSTRACT

An oriented graphite layer is formed on a metallic substrate by providing a coating of particulate carbon thereon, heating the coated substrate in a non-reactive atmosphere to a temperature of between 800° and 1350° C. for saturational diffusion of carbon into the substrate and cooling to a temperature below about 200° C., thereby providing a precipitated oriented graphite film at the surface of the substrate.

The substrate may be formed by covering a copper or copper alloy member with a continuous layer of nickel, cobalt, nickel alloy or cobalt alloy. In another embodiment, the substrate with an attached graphite coating is spirally bonded onto a copper tube for use in the field of condensation heat transfer.

10 Claims, 10 Drawing Figures

FIG. 2
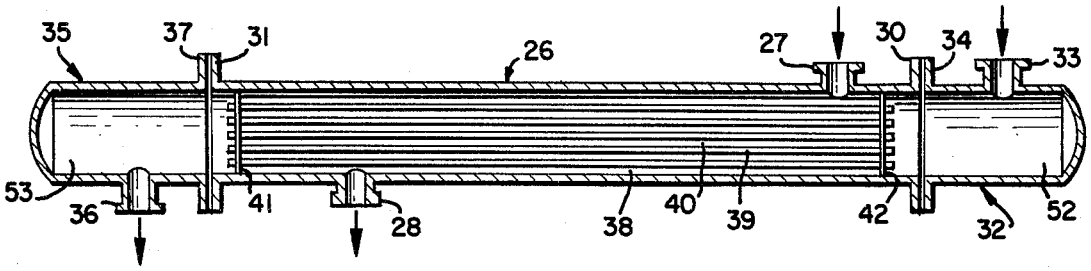
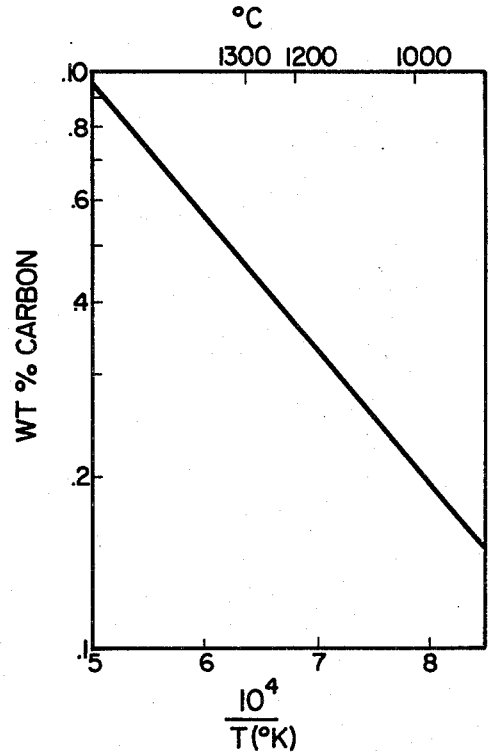
FIG. 4
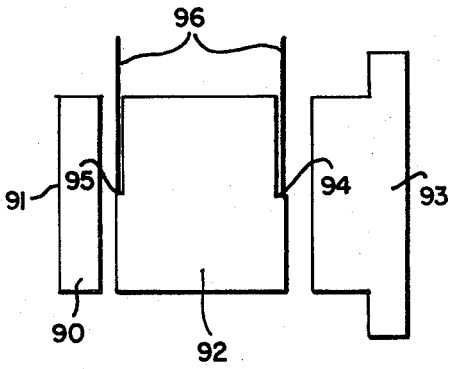
FIG. 6
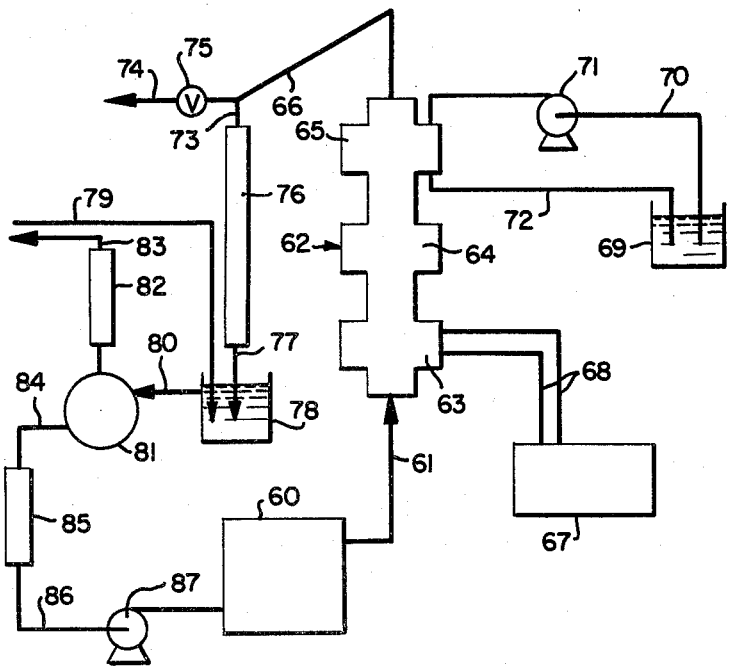
FIG. 5

ORIENTED GRAPHITE LAYER AND FORMATION

BACKGROUND OF THE INVENTION

1. Field of the Invention

This invention relates to enhanced dropwise condensing surfaces and to a method for forming a graphite coating on a metallic substrate which is characterized by a high degree of uniformity of the alignment of the basal planes in the graphite coating with respect to the coated substrate such that the graphite basal planes are essentially parallel to the coated surface.

2. Description of the Prior Art

In the field of condensation heat transfer, there has been a rigorous and continuing search for improved heat transfer surfaces which are characterized by high condensation heat transfer coefficients. Such improvement has been sought because it affords the opportunity to reduce the size of heat exchange apparatus and/or the energy requirements associated with the condensing operation. In particular, much effort has been expended to develop dropwise condensing surfaces, i.e., surfaces which are non-wettable with respect to the vapor component to be condensed, inasmuch as dropwise condensation heat transfer coefficients are in general significantly higher than filmwise condensation coefficients.

In the prior art, dropwise condensing surfaces have variously been produced by permanent bonding of organic coatings to the heat transfer substrate, by absorption of organic dropwise promoting agents on the substrate, and by noble metal, e.g., gold, plating of the substrate. Each of these techniques is characterized by inherent deficiencies which has prevented its broad commercial implementation. Permanently bonded organic coatings generally impose a significant thermal resistance to heat transfer, by virtue of their low thermal conductivity, which obviates any gain attributable to the dropwise character of the coated surface. Absorption of organic promotors on the heat transfer surface provides an enhanced condensing surface for only relatively short periods of service; continued use frequently results in loss of the dropwise character of the surface due to solubilization of the coating in the condensed liquid or to oxidation, hydrolysis, or other chemical reaction involving the organic material which destroys its promotor properties. Gold and other noble metal platings are prohibitively expensive for general commercial utilization.

Accordingly, it is an object of the present invention to provide an improved dropwise condensing surface.

It is another object of the invention to provide such a surface by a substrate coating which is easily formed and permanent in character.

These and other objects of the invention will be apparent from the ensuing disclosure and appended claims.

SUMMARY OF THE INVENTION

Briefly, the broad method aspect of the invention relates to forming an oriented graphite coating on a metallic substrate, such as may be usefully employed as a dropwise condensing surface. In this method a substantially uniform coating of particulate carbon is provided on the metallic substrate. The coated metallic substrate is heated in a non-reactive atmosphere to a temperature of between 800° C. and 1350° C. and below the melting point of the metallic substrate and that temperature is maintained for a period of time sufficient for saturational diffusion of the carbon into the substrate. Thereafter, the metallic substrate is cooled to a temperature below about 200° C., thereby providing a precipitated oriented film of graphite at a surface of the substrate.

The present invention in another aspect relates to a heat exchange member article of manufacture comprising a metal base material substrate, which may, for example, be in the form of a tube, and a continuous layer of graphite having a thickness of below about 0.05 mm on a surface of the substrate. The graphite layer has basal planes oriented substantially parallel to the surface of the substrate with a standard deviation of the angle of alignment between the graphite basal planes and the surface of the substrate between 0 and 4 degrees.

The graphite coated tubular substrate article of manufacture described above has broad utility in heat transfer applications wherein the graphite coated surface is employed for condensation of vapor containing a condensible component which is non-wetting with respect to the graphite layer. Such graphite coated tubes may be suitably disposed in a conventional tube array in a heat exchange assembly and employed, for example, for condensation of steam by heat exchange with a coolant medium flowing across the opposite tube surface from the graphite coated surface.

As used herein, the term "non-reactive atmosphere" refers to the gas or vapor environment in which the carbon-coated metallic substrate is heated for saturational diffusion of carbon into the substrate and indicates that such gas or vapor does not react with either the metallic substrate or the carbon coating to form substrate metal oxides or other compounds during the heating step or to form compounds which result in the removal or destruction of the carbon coating. The condition of "saturational diffusion of carbon into the substrate" means the heating step is carried out so that the thermal diffusion of carbon, at the upper heating temperature of 800° C. to 1350° C., produces a soluble concentration of carbon in the substrate metal adjacent to the surface at which the oriented graphite film is precipitated in the subsequent cooling step, which concentration equals or exceeds the saturation limit at a temperature between about 800° C. and 1350° C. so that carbon can diffuse to the surface and graphite can precipitate thereon either at the upper heating temperature or as the substrate metal is cooled. Such saturational diffusion condition is readily determinable from conventional solubility phase diagrams of carbon in the particular substrate metal employed and by appropriate choice of substrate metal temperatures in the heating step and mass loading of particulate carbon initially coated on the metallic substrate. The saturational diffusion condition is necessary in the practice of the present invention to insure that the graphite film will, in fact, precipitate at metal surface during the cooling step with a substantially uniform coating thickness.

BRIEF DESCRIPTION OF THE DRAWINGS

FIG. 2 is a shell and tube heat exchanger employing graphite coated tubes according to the present invention disposed in a parallelly extending tube array.

FIG. 4 is a graph of the solubility of carbon in nickel as a function of temperature.

FIG. 5 is a schematic diagram of apparatus used to test the condensing heat transfer performance of oriented graphite coatings prepared in accordance with the present invention.

FIG. 6 is a cross-sectional view in elevation of a heat transfer cylinder employed in the FIG. 5 test apparatus.

DETAILED DESCRIPTION OF THE PREFERRED EMBODIMENTS

Figure 1:
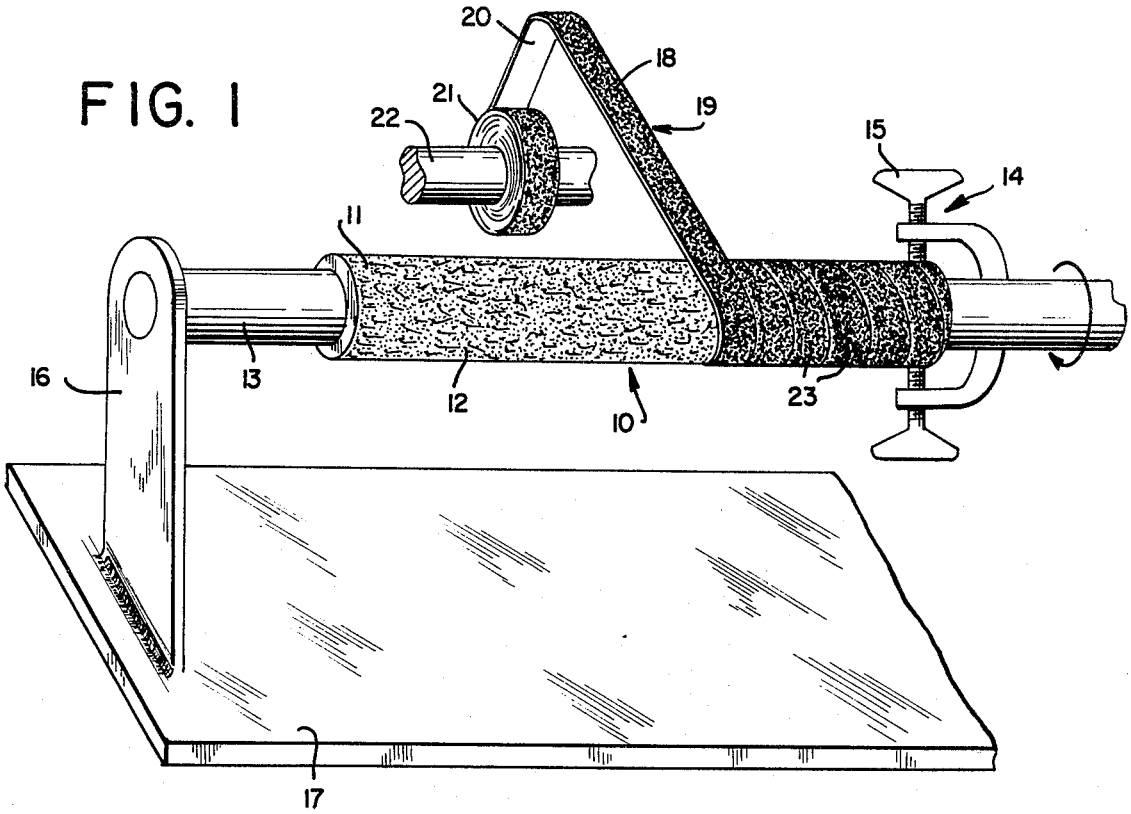
FIG. 1 shows the fabrication of an article of manufacture according to the present invention wherein a metal foil extended strip coated with an oriented graphite film is helically wrapped on a metal base material tube to provide a circumferentially and longitudinally extending layer of oriented graphite film on the tube.

In accordance with the present invention a permanently enhanced dropwise condensing surface is achieved by forming an oriented graphite coating on a metallic substrate. The term "oriented graphite" as used herein to characterize a film or coating of graphite means that the crystalline basal planes of the graphite are aligned substantially parallel relative to one another and to the surface on which the film or coating is formed. The method of this invention permits a graphite coating to be formed having an extremely high degree of orientation, as associated with a correspondingly low value of the standard deviation in the angle of alignment of the basal planes with respect to the substrate, as for example less than about 4 degrees. In such configuration the surface of the graphite film or coating is inherently hydrophobic and provides a highly efficient dropwise condensing surface for steam and other vapor components having similar wettability characteristics. The degree of orientation and the standard deviation in the angle of alignment for the graphite coatings of the invention are readily determinable by electron-diffraction and conventional x-ray crystallography methods, as will be shown more fully hereinafter.

On oriented graphite coated surfaces prepared in accordance with the present invention, steam condensation heat transfer coefficients have been measured and found to be three to four times higher than those which can be achieved by filmwise condensation. The oriented graphite possesses a thermal conductivity of approximately 3.4 calories/cm sec °K in the basal plane direction, i.e. parallel to the coated substrate, and a thermal conductivity of approximately 0.016 calories/cm sec °K in the direction perpendicular to the coated substrate and basal planes in the coating. The coating is therefore characterized by a moderately high thermal conductivity in the primary direction of heat flow—approximately 100 times greater than that of a typical organic dropwise promoting material—and by a very high thermal conductivity laterally along the surface of the coating, in the direction perpendicular to the heat flow direction. Although not firmly established, there is evidence that a high thermal conductivity in the direction parallel to a condensing surface may be essential to the achievement of high heat transfer coefficients during dropwise condensation.

An important feature of the present invention is that the oriented graphite coating is intimately bonded to the substrate on which it is formed, by virtue of the saturational diffusion of carbon into the substrate and subsequent precipitation of the graphitized carbon film at a surface of the substrate. There is thus little difficulty in mechanical handling and assembly steps involving the incorporation of the coated substrate article into heat exchange apparatus, since the coating is resistant to damage by impact or abrasion, as occurs for example when a tubular heat exchange article is forced through a tube sheet or tube baffle in the fabrication of shell and tube heat exchangers. Another important feature of the instant invention resides in the fact that the formation of the oriented graphite coating involves the initial step of providing a uniform coating of particulate carbon on the metallic substrate. By providing an initial surface coating of carbon in particulate form, as for example in the form of powder or granules, the carbon is advantageously applied at ambient or near ambient temperature conditions, and without recourse to special deposition chambers such as are required for the formation of graphite by pyrolysis of carbon containing vapors. For these reasons, the coating can be applied to complex and irregular substrated geometries in a conventional manner, as for example by dipping the substrate to be coated in a suspension of particulate carbon in a suitable volatile solvent. Inasmuch as the subsequent heating step, carried out to induce saturational diffusion of the carbon into the substrate metal and graphitization of the coated carbon is conducted at a temperature which is below the melting point of the metallic substrate, the oriented graphite coating may be formed without resort to high temperatures which may otherwise result in deformation of the substrate, as for example when the substrate is in the form of thin sheets or foils or long tubing. Such deformation must be avoided where the coated article is to be mass produced within closely controlled and reproducible dimensions, e.g., for assembly in heat exchanger tube sheets and casings. In addition, high temperatures above those contemplated in the practice of this invention are undesirable for the reason that they may cause excessive annealing of many useful metal substrates. If annealing occurs, an additional work hardening step may be required to provide an article of satisfactory strength. In the method of this invention, these disadvantages are avoided by the use of a maximum temperature which is in the range of between 800° C. and 1350° C. and below the melting point of the metallic substrate, thereby insuring the provision of a graphite coated article characterized by little or no deformation of the substrate and by satisfactory mechanical strength and hardness.

A further advantage of the use of a maximum temperature between 800° and 1350° C. is that the bond between the oriented graphite film and the metal substrate is maintained intact. At substantially higher temperature of formation, this bond is subject to severe stresses associated with the marked differential thermal contraction between the substrate and the graphite film which occurs upon cooling, resulting in the rupture of the bond and the loss of the graphite coating. By forming the oriented graphite coating under the conditions of this invention, such destruction of the bond between the graphite and the metal substrate is avoided.

The foregoing advantages of the oriented graphite coating produced by the method of this invention represent a substantial improvement over various prior art techniques which have heretofore been employed to produce graphite coatings for other applications in the art, as for example for jet and rocket engine nozzles, missile nose cones and thermoelectric devices. In these other areas of art, oriented graphite has been produced by subjecting graphitizable carbon to temperatures between 2800° C. and 3500° C. and to pressures of several hundred kg/cm$^2$; however, it has not been possible to obtain adherent oriented coatings on a metallic substrate by this technique. In addition, the high temperatures characteristic of this method may cause softening, deformation and annealing of the metal substrate, as discussed hereinabove. Furthermore, the use of such high temperatures makes it impossible to form adherent coatings of oriented graphite on metal substrates for the reasons discussed above.

Another method which has been employed to form graphite coatings is by pyrolysis of certain organic vapors and deposition of the resulting pyrolytic graphite on the substrate. However, these coatings typically exhibit only a low level of orientation except under special forming conditions, e.g. the use of catalytic surfaces and very slow deposition rates. Such pyrolytic graphite coatings generally require the use of high temperatures ranging from about 1450° C. to 2500° C. and thus are not suitable for the majority of metallic substrates but rather are limited in practical utility to substrates such as refractory materials or to graphite itself. It is possible to produce pyrolytic graphite coatings at lower temperatures, as for example at 800° to 1050° C., but use of such temperatures in the pyrolysis method requires excessively long treatment times for practical use and produces thin, discontinuous graphite coatings of low quality. Accordingly, because of the high temperatures generally employed to produce good coatings by pyrolysis, a bond cannot be maintained between the pyrolytic graphite film formed on the substrate and the substrate itself when the substrate is cooled from the formation temperature of the graphite unless the substrate material has a coefficient of thermal expansion very close to that of the graphite film. Such constraint excludes common metals from being used as a substrate in this method.

Other attempts have been made to produce pyrolytic graphite coatings at lower temperatures, as for example at 600° to 1200° C., by pyrolysis of organic vapors in the presence of the high electric fields, but the coatings thus formed exhibit only a low degree of orientation.

The oriented graphite coating of this invention differs both in form and method of manufacture from the prior art technology described above. In the present invention, the metal substrate participates in the formation of the coating directly as a solvent medium in which the carbon dissolves and diffuses and in which the carbon is transformed to the graphite phase during or prior to the final precipitation of coating on a surface of the metal substrate. As a result, the coating and substrate are intimately, integrally joined together. The coating of this invention is produced at temperatures which are generally lower than those employed in the prior art for the production of pyrolytic graphite coatings, and the coating is formed by direct interaction between the carbon and metal substrate rather than through the pyrolysis of a carbon containing intermediate organic compound and subsequent deposition of the carbon on a substrate surface.

The method of the instant invention involves an initial step of providing a substantially uniform coating of particulate carbon on the metallic substrate. It is important in the practice of the invention to provide coating which is substantially uniform in order that the final precipitated oriented graphite film is uniform in thickness and is devoid of any bare spots, surface imperfections or otherwise non-oriented film portions. If the substrate is a planar surface or otherwise regular in geometry, the particulate carbon may be applied to the metallic substrate in the form of a dry powder. Alternatively the particulate carbon may be applied to the metallic substrate in the form of a slurried colloidal dispersion of carbon in a carrier solvent. In the latter case, the dispersion-applied particulate carbon may be dried to form a randomly oriented particulate carbon coating on the substrate prior to further treatment. The colloidal dispersion of graphite may comprise a suitable carrier, as for example isopropanol, so that the colloidal dispersion may be painted onto the substrate metal by brush, roller or other conventional application means. In some cases where the substrate to be coated involves an extremely irregular surface characterized by substantial surface distortions, it may be advantageous to apply the particulate carbon in the form of a carbon-binder composition, such as a mixture of viscous hydrocarbon binder and petroleum base solvent, e.g., a 50-50 weight percent mixture of isobutylene polymer and kerosene.

Under the instant invention, the metallic substrate to be coated should be formed of a material which is chemically inert to carbon (as to the formation of thermodynamically stable compounds) at temperatures in the range in which the carbon dissolves in and diffuses through the substrate and precipitates on the substrate surface as oriented graphite. It is to be understood that at temperatures below the lower limit of this range, which is about 800° C., the substrate metal can be one which forms stable compounds with carbon provided that these compounds are thermodynamically unstable with respect to their dissociation to carbon at temperatures above about 800° C. Furthermore, the material should be one in which the solubility of carbon at the high temperature employed in the graphitization step is at least 0.1 weight percent. Suitable metallic substrate materials satisfying the above requirements include iron, iron alloy, nickel, nickel alloy, cobalt and cobalt alloy. Nickel is generally preferred as a metal substrate material due to the relatively high solubility of carbon in nickel at temperatures in the range of 800° C. at 1320° C. At 1320° C., a carbon nickel eutectic mixture is formed, and this temperature is significantly below the melting point of the nickel metal substrate. At this temperature the solid solubility of carbon in nickel is 0.5 weight percent and the rate of diffusion of carbon into the metal is substantial. Cobalt is also a preferred metal substrate material for the reason that its phase diagram with carbon is quite similar to that of the nickel-carbon phase diagram and therefore the conditions for the formation of the oriented graphite coatings of this invention on the cobalt substrate are similar to those employed for making the coating on nickel substrate material. Iron is another suitable substrate metal material although iron to be useful is preferably supplied in the form of relatively pure material and requires a relatively slow cooling step to prevent the formation of metastable iron carbides. The formation of iron carbide effectively prevents the graphite from diffusing to the surface during the cooling step and forming an oriented graphite film. In addition to the foregoing, nickel-ferrous alloys containing a high concentration of nickel have been found useful in the practice of the present invention. Although copper has substantial thermal conductivity and thus is preferred in many applications as a heat transfer substrate material, it is not, in general, suitable in the practice of the present invention as a metallic substrate, due to the very low solubility of carbon in copper and most copper alloys. In view of the desirability of using copper or copper alloy as a metallic substrate material for heat transfer applications, it has been found advantageous in the practice of the invention to employ a copper or copper alloy metallic substrate covered with a continuous layer of nickel or nickel alloy or cobalt or cobalt alloy, with the oriented graphite coating being formed on the latter layer of metal material. Such a continuous layer may be formed by bonding a foil of nickel, nickel alloy, cobalt or cobalt alloy on the copper base material, or, alternatively, by electroplating these metals on the substrate, by vapor deposition of the metals, or any other suitable plating method. Particularly advantageous copper base materials include 90-10 copper nickel alloy and a 15% nickel copper alloy containing a chromium additive, sold commercially as International Nickel 838, manufactured by International Nickel Company, New York, N.Y. 10004. These base metals are suitably employed with a metal overlay of nickel, preferably in a wrought configuration.

In the graphitizing heating step, the coated metallic substrate is heated in a non-reactive atmosphere to a temperature of between 800° C. and 1350° C. and below the melting point of the metallic substrate. As previously discussed, this temperature level is maintained for a period of time sufficient for saturational diffusion of the carbon into the metal substrate. The non-reactive atmosphere is taken to include both a gas atmosphere and vacuum environment containing insufficient oxygen to permit oxidation of the metallic substrate during the graphitizing heating step. To this end, it is important that the metal substrate initially be clean and free of any oxide promoting chemical contaminants or oxide coatings. If the metallic substrate has been deoxidized immediately prior to the practice of the coating method of this invention, the graphitizing heating atmosphere may be inert as for example argon or nitrogen gas, although a reducing gas could also be employed so long as it does not contain hydrogen or other compounds which react with the carbon. At the outset of the graphitizing heating step, the uniform coating of particulate carbon which has been applied in the preceding step may first be dried either by evaporation or heating of solvent from the initial coating material in the event that the coating of particulate carbon is applied to the metalic substrate in a solvent-based solution or a binder composition. Prior to the graphitizing heat treatment step, the surface coating of particulate carbon is dull, loosely adherent, and hydrophilic, with a random orientation of any crystalline basal planes in the coating. This loosely adherent carbon coating is easily rubbed off the substrate metal by mechanical action. After the graphitizing heat treatment, the coating is strongly adherent, shiny and hydrophobic.

In the graphitizing heating step, the coated metallic substrate is raised in temperature to between 800° C. and 1350° C., and this temperature is maintained only for sufficient time to allow saturational diffusion of carbon into the metallic substrate. Relative to the time required for phase transition of the particulate carbon to graphite, the saturational step is slow and controls the time requirement for the heating step. If heating step temperatures below 800° C. are employed, the concentration of carbon is generally too low to produce a uniform coating of graphite and the times for diffusion of carbon into and out of the substrate are prohibitively long. Temperatures in the heating step above 1350° C. are generally to be avoided because they approach the softening and/or melting points of most useful substrate metals. If the particulate carbon coating is applied in a solvent carrier or binder, it may be desirable to effect the initial heating at a relatively slow rate in order to allow for evaporation of solvent and volatile materials in the particulate carbon coating, in order to avoid blistering or lifting off of the coating from the metallic substrate. The heating step carried out to effect formation of the oriented graphite coating may suitably be conducted at a rate of between 0.35° and 300° per minute and may suitably be conducted in a furnace comprising two zones wherein the coating is first dried in a lower temperature first zone and thereafter is heated at higher rate in a hotter second zone. The upper heating temperature of the graphitizing step may be maintained for a period of between 0.5 minutes and 24 hours, and preferably between 5 minutes and 10 hours.

Figure 3:
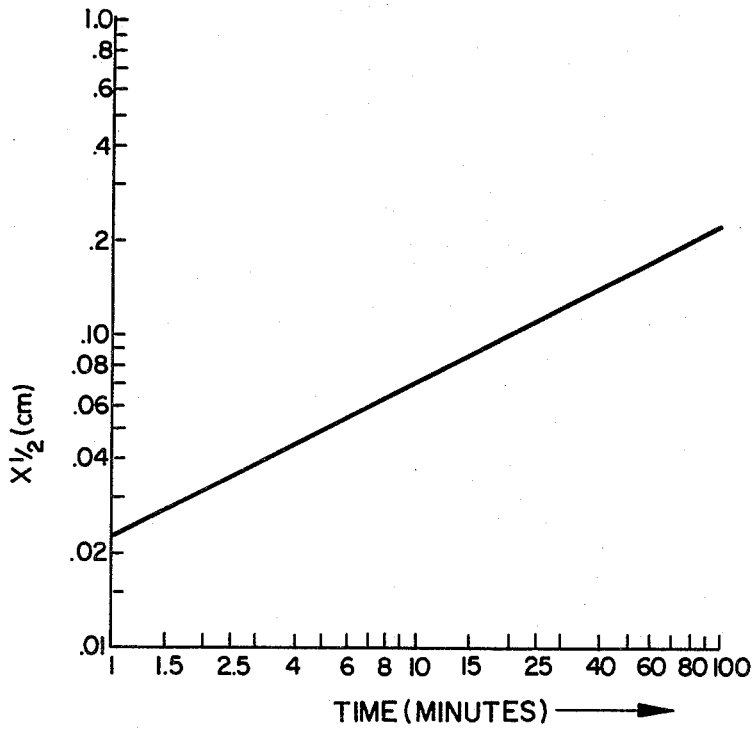
FIG. 3 is a graph of the position of the half maximum of the carbon concentration gradient with respect to the initial carbon-nickel boundary, for diffusion of carbon into nickel at 1320° C.

During the heat treatment process, the carbon diffuses into the metal and dissolves therein, undergoing a phase transition to graphite as it diffuses out of the metal and precipitates on the surface. At the graphitizing heating temperatures contemplated in the practice of the instant invention, the rate of diffusion is sufficiently high to enable the heat treating process to be carried out within a comparatively short time. FIG. 3 illustrates the rapid diffusion of carbon into nickel substrate metal at the carbon-nickel eutectic temperature. The illustrated graph shows the position of the half-maximum of the carbon concentration profile with respect to the initial carbon-nickel boundary as function of heat treating time, for the eutectic temperature of 1320° C. As shown by FIG. 3, after only 20 minutes of heat treating at 1320° C. the half-maximum of the carbon-nickel concentration profile has moved into the substrate metal to a distance of 0.1 cm. The graph of FIG. 3 is based on ideal steady state diffusional conditions. If the elapsed time for the heating step is insufficient for equilibrium to be achieved, a concentration gradient will exist in the metal substrate with a maximum concentration located at the surface which was originally coated. As the surface is cooled in the subsequent step the region near the surface of the metal substrate will reach supersaturation first and precipitation of graphite will occur on the surface. If the temperature is lowered slowly enough, there will be diffusion of dissolved carbon toward this precipitate which acts as a nucleation site and further growth of the oriented graphite crystalline structure can occur. The existence of small temperature gradients within the substrate material and the existence of preferential nucleation sites both on the surface and within the bulk of the metallic substrate will substantially modify this ideal behavior.

In the practice of the present invention, it is important to provide on the surface of the metallic substrate a sufficient amount of particulate carbon prior to the initiation of the heating step, in order that the oriented graphite film precipitated in the final step of the process is uniform in thickness. The loading of graphite which is desirable for a given coating is readily determinable on the basis of solubility and diffusion rate considerations. At carbon loadings well below the solubility limit of carbon in the substrate metal, heat treatment time is important for the development of continuous and well oriented coatings. Results of heat treatment tests indicate that when the loading of particulate carbon on the substrate metal is well below the solubility limit only spotty coatings are obtained if the heat treatment time exceeds the diffusion time requirement. In this case, the carbon diffuses into the substrate to such extent that there is no region in the vicinity of the substrate surface which is saturated with carbon at a temperature which allows sufficiently rapid diffusion of carbon to the surface. In this case the amount of dissolved carbon which can diffuse to the surface and precipitate as graphite is not sufficient to form a uniform coating. Such a saturated region is necessary for the precipitation of the oriented graphite layer on the metal surface. At the other extreme, if the heat treatment is too brief, unreacted carbon will remain on the surface. Unreacted carbon will also remain on the metallic substrate surface if the carbon loading is excessive, as is the case if the weight percent loading of particulate carbon on the substrate in the initial coating step greatly exceeds the amount of carbon soluble in the substrate metal as based on time/temperature considerations.

The foregoing considerations indicate that it is necessary to maintain a region of saturation in the vicinity of the metal surface in order to precipitate oriented graphite on the surface of the substrate metal. In the case of thin substrates for which even brief heating times cause substantially all of the carbon corresponding to the solubility loading to diffuse into the metallic substrate, this objective may suitably be achieved by loading one surface of the sample with an amount of particulate carbon slightly in excess of the solubility limit for the substrate metal considered. In this case, an oriented film of graphite will form on the opposite surface. For thick substrates, it may be impractical to insure the presence of saturated conditions in the vicinity of the metal surface on which it is desired to form the graphite film by excess surface loadings of carbon, and in such case it is necessary to closely control the heat treatment time, as governed by the amount of carbon initially present on the substrate surface. The heat treatment time in all cases is that time which allows the carbon to diffuse into the metallic substrate but which is not so long that the concentration of dissolved carbon in the vicinity of the substrate surface falls below a level corresponding to saturation at a temperature at which sufficiently rapid diffusion can occur for the carbon to migrate to the surface and precipitate as a uniform graphite film during the cooling step. In general this condition requires that the concentration of carbon in the vicinity of the substrate surface corresponds to saturation at temperatures between about 800° and 1350° C.

As indicated previously, copper and copper alloys are not desirable metallic substrates for direct coating by carbon in the manner of the present invention. Nonetheless, copper is preferred in many applications as a heat transfer substrate material. Accordingly it has been found advantageous in the practice of the invention to employ a thin metal foil as the metallic substrate for direct coating purposes, with the oriented graphite coated metal foil in turn being applied to the base metal substrate, which may then suitably be of copper or copper alloy. Such procedure has been found particularly advantageous due to the fact that it is difficult to provide the exact solubility loading of particulate carbon on the surface. With the substrate in the form of a thin metal foil it is possible to control the diffusion precipitation reaction closely by loading an excess amount of carbon onto one side of the thin metal foil in the initial particulate carbon coating step and conducting the heating and subsequent cooling steps of the present method such that the oriented graphite film is precipitated on the other side of the thin metal foil. In this method, the thin metal foil should have a thickness of between about 0.025 mm and 1 mm. The lower thickness limit if based on consideration of mechanical handling and structural integrity of the metal foil. At foil thicknesses below about 0.025 mm, the foil becomes excessively fragile and is susceptible to splitting or tearing in handling. The thickness of the metal foil should not exceed about 1 mm for the reason that thicknesses above such level are associated with excessive requirements of carbon to achieve the necessary concentration in the vicinity of the opposite surface and with disproportionately high resistance to diffusion of carbon through the metal foil, to the side opposite that which is initially loaded.

Following the heat treatment graphitization step the metallic substrate is cooled to a temperature below about 200° C., thereby providing a precipitated oriented graphite film at a surface of the substrate. The temperature of the substrate should be lowered in a uniform manner at a rate which is suitable to cause the initially precipitated oriented graphite at the surface of the substrate to act as a nucleation site and promote further growth of the oriented layer. Under these considerations, the cooling step is suitably carried out at a rate of between 0.1 and 133° C. per minute. Rates below 0.1° C./minute are not in general desirable for the reason that excessively long cooling periods are associated therewith, without corresponding improvement in the characteristics of the oriented graphite layer; cooling rates substantially above 133° C./minute, on the other hand, may give rise to nonuniform growth of crystallites in the precipitated layer and the resulting film being characterized by poor orientation characteristics and nonuniformity of the graphite cooling.

It will be recognized from the foregoing discussion that many possible combinations of particulate carbon loading on the substrate metal surface, graphitization heating time, and graphitization heating temperature are possible within the broad scope of the present invention, depending among other things on the compositional characteristics of the substrate metal employed. However, by way of example, satisfactory oriented graphite coatings have been formed on thin metal strips of cobalt by precipitation of the oriented graphite film at the surface initially coated with particulate carbon, by employing a temperature in the graphitization heating step of from 1100° to 1200° C., a graphitization heating step time of from 30 minutes to 1.7 hour, and a weight percent carbon surface loading on the metallic substrate of from 0.40 to 0.51 weight percent. In the production of oriented graphite films on the opposite side of cobalt foils from the side initially coated with particulate carbon, good results have been achieved employing graphitization heating temperatures in the range of from 1100° to 1300° C., graphitization heating time of from 30 minutes to 1.5 hours, and with an excess carbon loading on the surface of the thin cobalt metal foil opposite that at which the oriented graphite film is precipitated. On thin nickel metal strips, satisfactory graphite coatings have been obtained using from 0.12 to 0.9 weight percent carbon loadings on the substrate surface, a graphitization heating time of from 0.5 minutes to 10 hours, and a graphitization temperature of from 1000° C. to 1315° C.

FIG. 1 shows the fabrication of an article of manufacture according to the present invention wherein a metal foil extended strip coated with an oriented graphite film is helically wrapped on a metal base material tube to provide a circumferentially and longitudinally extending layer of oriented graphite on the base material tube. As shown in the drawing the metal base material tube 10 is supported on horizontally aligned cylindrical member 13 the end of which is journaled into a vertically oriented support flange 16 which is in turn supported on the base support member 17. The base metal material tube is retained in position on the cylindrical support member 13 by means of the securement assembly 14 utilizing circumferentially spaced set screws 15 to hold the tube in place. The set screws also serve the function of retaining the metal foil, having an oriented graphite film on one side thereof, in place at the end portion of the base metal material tube. The metal foil extended strip 19 is supplied from a roll 21 retained on a cylindrical roller 22. Tension is maintained in the metal foil strip adjacent to the roll 21 by suitable means not shown in the drawing. In operation the horizontally aligned cylindrical support member 13 is rotated at constant speed and the metal base material tube thereby is helically wrapped with the metal foil extended strip to provide a circumferentially and longitudinally extending continuous layer of precipitated oriented graphite film on the surface of the tube. Prior to application of the extended strip metal foil the outer surface of the tube 11 is coated with a suitable bonding medium 12. The bonding medium may, for example, comprise an adhesive material. Preferably the bonding medium is thermally conductive to provice low resistance transfer of heat from the metal foil to the tube when the metal base material tube is used for condensation heat transfer applications. The bonding medium may also suitably comprise a metal or metal alloy having a melting point below about 1000° C. and the melting point of the base material of the tube and of the metal foil. The side of the metal foil opposite the side containing the precipitated oriented graphite film may then be aligned with the tube outer surface with the bonding medium disposed therebetween to permit heating of the tube to a temperature sufficient to melt the bonding medium. After heating, the foil covered tube is cooled to a temperature below the melting point of the bonding medium, for bonding of the metal foil to the metal tube surface.

In practice, a metal foil having a precipitated oriented graphite film on one surface thereof may be prepared in the following illustrative manner. It will be appreciated that the following description is presented by way of example only, and is not intended to be construed in any limiting manner as regards the coating preparation methods which may advantageously be employed in the broad practice of the present invention. In the illustrative method a coil of nickel foil 7.6 cm in width and 0.02 cm in thickness which is mounted on a roll is unwound and treated sequentially for surface preparation and subsequent coating of the particulate carbon material. The foil is initially passed through a degreasing bath containing a suitable solvent as for example trichloroethane following which the foil is air dried at approximately ambient temperature. A surface of the cleaned nickel metal foil is then coated with a colloidal dispersion of graphite in an isopropanol alcohol solvent solution. The colloidal dispersion of particulate graphite may be applied by any suitable conventional application means such as by brushing, spraying or roll coating. Following the initial coating step the nickel film is again air dried to evaporate solvent and to provide a uniform coating of dried particulate carbon on the metallic substrate. The coated nickel foil is then furnace heated in an argon atmosphere to a temperature of approximately 1150° C., with the metal foil being passed through the furnace zone at a linear rate of 10 inches per minute. In this manner, the temperature of the thin metal foil is raised to a temperature, below its melting point, to a level which is sufficient for saturational diffusion of the particulate carbon to occur, with the carbon undergoing diffusion from one side of the metal foil to the other side thereof and undergoing graphitization. Following the heating step, the metal foil is cooled to about ambient temperature over a period of approximately 10 hours. An oriented graphite film precipitates at the opposite side of the metal foil from that which was initially coated with particulate carbon, and the nickel foil is now ready to be attached to the metal base material tube. Any residual particulate carbon on the initially coated surface or any precipitated oriented graphite thereon may be removed to produce a suitable surface for adhesive bonding by sanding or low intensity mechanical abrading of the initially coated metal foil surface. The metal foil may then be bonded to the outer surface of the metal base material tube in thermal contact therewith, in the manner previously described.

Metal base material to be used should be reasonably straight; any grease or oil on the outer surface may suitably be removed by batch dipping of the tube or tubes in chloroethylene or other suitable degreasing solvent. The metal base material tube is in position on the horizontal cylindrical support member 13 and secured by securement assembly 14. During the application of the thin nickel foil to the metal base material tube the horizontal cylindrical support member 13 is rotated at slow speed. This may be effected either manually or by suitable drive means as for example an electric motor. The roll of coated nickel foil is suitably positioned to provide foil to the rotating metal base material tube at the correct helical angle and under tension, as mentioned. The end of the foil is cut at a suitable angle and then is attached to the tube as for example by tack welding using capacitors, in a manner well known to those of ordinary skill in the art. The tube on the horizontal cylindrical support member is then heated locally up to the point where a suitable solder medium will run freely. At this point flux and solder are fed onto the tube outer surface, and rotation and longitudinal traverse of the metal base material tube is initiated. The nickel foil is kept under tension and fed automatically or manually onto the turning tube. When the correct length of tube is taped the machine is stopped, the foil is cut, heating is terminated and an air blast chills the tube. The metal base material tube may then be removed from the coating assembly and washed in a water tank to remove extra flux. This step of the coating process, the flux removal, may otherwise be performed while the tube is still rotating, thereby defluxing and cooling the tube simultaneously. As a final step the tube is dried, cut to length and may then be suitably deployed in a heat transfer assembly for condensation heat transfer by dropwise condensation of vapor on the oriented graphite surface.

The article of manufacture produced by the above described process of this invention comprises a metal base material tube and a continuous layer of graphite having a thickness of below about 0.05 millimeters on a surface of the tube. The graphite layer has basal planes oriented substantially parallel to the surface of the tube with a standard deviation of the angle of alignment between the graphite basal planes and the surface of the tube of between 0° and 4°. Preferably, the continuous graphite layer has a thickness of between about 0.0002 and 0.02 millimeters and the standard deviation of the angle of alignment of the oriented graphite basal planes is less than about 2°. A thickness of the continuous layer of graphite on the surface of the basal metal material tube of below about 0.05 millimeters is desirable for the reason that at thicknesses above this level an excessive amount of particulate carbon must be applied in the initial coating step, and additionally, it is difficult to achieve films of thickness greater than aout 0.05 mm due to the inherent difficulties of controlling the diffusion/graphitization process. The standard deviation of the angle of alignment between the graphite basal planes and the surface of the base metal material tube is desirably below 4° for the reason that above this angle the degree of randomness of the oriented basal planes is such that the hydrophobic character of the graphite surface is impaired. When the article of manufacture is formed by foil overlay on a surface of the base metal material tube, as opposed to direct coating of the oriented graphite surface thereon, it is desirable to maintain the thickness of the metal foil between 0.025 and 1.0 mm in thickness, for the reasons previously described. In the coating method as described in connection with FIG. 1, the oriented graphite continuous layer is integrally bonded to the surface of the layer of foil and the foil is bonded to the outer surface of the base metal material tube. By such forming technique, the base metal material tube may suitably be formed of copper or copper alloy, as is advantageous for heat transfer applications, even though copper or copper alloy is not a suitable base metal material for direct coating of the oriented graphite layer.

FIG. 2 is a shell and tube heat exchanger employing graphite coated tubes formed according to the present invention, disposed in a parallel extending tube array. This heat exchanger is especially adapted for enhanced dropwise condensation heat transfer and comprises a multiplicity of oriented graphite coated tubes prepared in accordance with the method of this invention, disposed in parallelly extending, laterally spaced-apart relationship to form an array. The tubes 39 are disposed in the inner/cylindrical space 38 of the intermediate section 26 of the shell and tube heat exchanger. The tubes are each joined at one end in closed flow communication with fluid inlet header means comprising tube sheet 42 and inlet heat exchanger section 32 providing a fluid inlet conduit 33 communicating with the head space 52 therein. The inlet heat exchanger section 32 is provided with flange members 34 which mate with flange members 30 of the intermediate heat exchanger section 26. Similarly, the heat exchanger tubes are joined of their opposite ends in closed flow communication with fluid exit header means comprising tube sheet 41 and exit heat exchanger section 35 which is provided with exit conduit means 36 communicating with the head space 53 of the exit header section. The exit header section is likewise provided with flange members 37 which mate with the flange members 31 of the intermediate heat exchanger section 26. By these means a heat exchange coolant fluid is suitably flowed from the inlet header means internally through the tubes to the exit header space means. Means are also provided in the heat exchanger assembly for flowing a vapor through the tube array, through the passage spaces 40 between the tubes, and over the outer surfaces of the tubes in the array, in indirect heat exchange relationship with coolant fluid being flowed internally through the tubes. The vapor containing condensible component(s) is introduced to the passages between the adjacent tubes in the heat exchanger tube array by inlet conduit 27 and condensate and uncondensed vapor is removed from the heat exchanger assembly through the outlet conduit 28 communicating with the intermediate heat exchanger section 26 interior space 38. In this manner dropwise condensation of the condensible components in the vapor may be effected on the graphite coated outer surfaces of the tubes.

In operation of the heat exchanger illustrated in FIG. 2, a method of enhanced dropwise condensation heat transfer on a heat transfer wall with continuous graphite layer on one surface thereof is carried out. The tubes in the heat exchanger are preferably constructed and the graphite layer is so formed that the basal planes of the graphite layer are oriented substantially parallel to the outer wall surface of the heat transfer wall with a standard deviation of the angle of alignment between the graphite basal planes and the coated wall surface of less than about 4° and with the opposite surface of the heat transfer wall in contact with the coolant fluid. The graphite layer is thereby contacted with a vapor containing a condensible component which is non-wetting with respect to the graphite layer, for transfer of heat from the vapor across the heat transfer wall to the coolant fluid and dropwise condensation of the condensible component on the graphite layer. The heat exchanger of FIG. 2 is particularly advantageous for purposes of steam condensation, by virtue of the hydrophobic character of the oriented graphite surface of this invention.

As indicated above, the article of this invention contemplates an oriented graphite layer characterized by a standard deviation of the angle of alignment between the graphite basal planes and the surface of the base metal substrate of between 0° and 4°. This standard deviation of the angle of alignment is proportional to the so-called rocking angle, as the latter term is commonly employed in the art. This angle is measured by the full width at the half maximum amplitude of the distribution of the angular orientation of the graphite basal planes, and is a measure of the quality of the oriented graphite coating. The angular full width at half maximum amplitude (rocking angle $\Delta\theta\frac{1}{2}$ may suitably be measured by the process described below, and for a Gaussian distribution of the angular alignment of the basal planes the angular full width at half maximum amphitude is related to the standard deviation in the angular alignment $\sigma$, by the formula:

$$\sigma = 0.425\Delta\theta_{\frac{1}{2}}$$

The illustrative measurement technique is based on the use of an xray diffractometer of conventional design. A coated sample having a graphite layer on a surface thereof is mounted in the diffractometer unit as flatly as possible. The main source and detector of the diffractometer are rotated for maximum intensity of the diffraction from the graphite (002) peak. With the beam and the detector in this fixed position, the sample is rotated through the peak and the intensity recorded as a function of angle. An approximate correction for instrumental broadening is obtained by scanning the peak at $2\theta = 31.8°$ of single crystal NaCl in the same manner. For the diffractometer used in this example, the full width at half maximum amplitude, $\Delta\theta_{\frac{1}{2}}$, of this peak is 0.375°. The observed full width at half maximum of the graphite peak is corrected for instrumental broadening by using this value and assuming the Gaussian line shapes with the equation as follows:

$$\Delta\theta_{\frac{1}{2}}\text{ (graphite)} = \sqrt{\Delta\theta^2_{\frac{1}{2}}\text{ (observed)} - \Delta\theta^2_{\frac{1}{2}}\text{ (NaCl)}}$$

where $\Delta\theta_{\frac{1}{2}}$ (graphite) = corrected full width at half maximum of the angle of alignment;

$\Delta\theta_{\frac{1}{2}}$ (observed) = observed full width at half maximum of the angle of alignment;

and $\Delta\theta_{\frac{1}{2}}$ (NaCl) = full width at half maximum of the angle of alignment of NaCl calibrating material.

In graphite layers having a standard deviation of the angle of alignment between the graphite basal planes and surface of the metal substrate of between 0° and 4°, the graphite coating possesses good orientation and is highly hydrophobic in character. According to the equations above, such graphite coatings are characterized by measured rocking angles of less than 9.5°, corresponding to actual corrected rocking angles of less than 4°.

The invention will be more fully understood by the following examples:

EXAMPLE 1

This example illustrates the superiority of the method of the present invention in producing an oriented graphite coating relative to prior art methods involving pyrolysis of organic vapors. Pyrolysis of inorganic vapors, as discussed hereinabove, generally does not produce an oriented graphite layer which is integrally bonded to the metal substrate. However, it is possible to produce small deposits of oriented graphite which are generally not continuous by pyrolysis. Pyrolytic graphite coatings were prepared in this example by pyrolysis of benzene vapor over nickel. The resulting surface was not hydrophobic in character, but graphite was detected by observation of the (002) x-ray diffraction line of graphite. The results of the comparative tests are summarized below in Table I and represent various temperature/time parameters for the method of vapor pyrolysis of benzene, as compared to a method conducted in accordance with the instant invention, wherein diffusion of carbon into the metal substrate and graphitization is conducted at a temperature of 1350° with a heating graphitization step time of 2 hours.

TABLE I

Comparative characteristics of Graphite Layers Formed by Pyrolysis and by Diffusion/Graphitization

| Graphite Coating Forming Method | Graphite Coating Forming Temperature (°C.) | Graphite Coating Forming Heating time (hr) | Relative x-ray Intensity of Graphite Layer (arbitrary units) |
|---|---|---|---|
| Vapor Pyrolysis | 800 | 300 | 400 |
| Vapor Pyrolysis | 1050 | 60 | 448 |
| Vapor Pyrolysis | 1050 | 15 | 632 |
| Diffusion/ Graphitization | 1350 | 2 | 95,360 |

As indicated in the table, the x-ray intensity of the graphite layer, which provides a measure of the orientation of the basal planes as well as the amount of oriented graphite present therein, was measured in arbitrary units, consistent among the individual samples tested. The substantially lower x-ray intensity of the vapor pyrolysis graphite coatings indicates that a much smaller quantity of oriented graphite had been produced, i.e., the degree of formation of well oriented graphite was low, even though the graphite coating forming heating times were substantially longer for the vapor pyrolysis technique than for the diffusion/graphitization method of the instant invention. These results show that the graphite coatings formed by vapor pyrolysis were not highly oriented and this conclusion was substantiated by wetting of the formed surfaces with water, which showed the pyrolysis coatings were not hydrophobic whereas such characteristic was obtained with the sample prepared in accordance with the method of the present invention.

EXAMPLE 2

This example illustrates the formation of an oriented graphite coating on a metal substrate under conditions which lead to saturational diffusion in the vicinity of the surface but under conditions for which there is insufficient carbon to saturate the entire volume of the metal substrate.

One face of a nickel cylinder weighing 56.69 gm and having a diameter of 2.5 cm and a length of 1.7 cm was painted with a colloidal dispersion of carbon in isopropanol. When dried, the carbon weighed 0.0297 gm or 0.05 percent of the weight of the nickel cylinder. The nickel cylinder, thus coated with unoriented carbon on one of its faces, was heated to 1340° C. in an argon atmosphere and held at that temperature for 1.5 hours. Upon cooling the sample, a lustrous, adherent, hydrophobic film of oriented graphite was formed on the face which had been coated with carbon prior to the heat treatment. Saturational diffusion of the carbon into the nickel was achieved in the vicinity of the surface to be coated by the appropriate choice of carbon loading, heat treatment time and heat treatment temperature, despite the fact that there was an amount of carbon inadequate to saturate the entire volume of the nickel substrate. To saturate the entire volume of the nickel at the heat treatment temperature, an amount of carbon equal to approximately 0.6 percent of the weight of nickel, or 0.31 gm, would have been required instead of the 0.05 percent by weight of carbon which was used in this example.

EXAMPLE 3

In this Example, the relationship between the rocking angles which characterize the alignment of the graphite basal planes and particulate carbon loading and heating soap parameters, for graphite coated samples prepared in accordance with the method of the present invention was explored. The rocking angles of the graphite coatings were measured for four coatings produced under different process conditions on a 0.076 mm thick nickel foil at heat treatment temperatures, in the graphitization heating step, of 1000° C., 1232° C., and 1315° C. The rocking angles were measured in accordance with the diffractometer procedure previously described. Results of the rocking angle measurements, together with tabulation of weight percent loading of carbon on the base metal substrate, graphitization heating temperature, and graphitization heating times are set forth below in Table II.

TABLE II

| Rocking Angle Measurements for Oriented Graphite Layers on Nickel Foil Substrates | | | |
|---|---|---|---|
| Loading of Particulate Carbon on Metal Substrate | Graphitization Heating Temperature | Graphitization Heating Time | Rocking Angle of Graphite Coating |
| .14 | 1000° C. | 1 hr. | 2.9° |
| .14 | 1000° C. | 5 hr. | 6.2° |
| .50 | 1232° C. | 5 min. | 2.3° |
| .84 | 1315° C. | 15 min. | 2.3° |

All of the samples represented in the Table were prepared in an argon atmosphere except for the 1232° C. sample which was prepared in vacuum. Comparing the two samples prepared at a graphitization heating temperature of 1000° C., both employing the same loading of particulate carbon on the metallic substrate in the initial coating step, it is apparent that the graphitization heating time of 5 hrs. results in a coating of poorer quality. As tabulated, the sample which was heated for 5 hrs. exhibited a rocking angle of 6.2° whereas the sample prepared with a graphitization heating time of only 1 hr. with the same loading and at the same heating temperature exhibited a rocking angle of only 2.9°. Comparing the two oriented graphite layers prepared at 1000° C. with the samples prepared at higher temperatures it is apparent that at higher temperatures higher loadings of particulate carbon on the metal substrate together with generally shorter graphitization heating times are required to produce satisfactory oriented graphite layers. Higher loadings and lower graphitization heating times are a consequence of faster diffusion rates and higher carbon solubilities which are characteristic of higher temperatures. This is illustrated by FIG. 3 which shows the position of the half-maximum of the carbon concentration profile with respect to the initial carbon nickel boundary plotted as a function of time. The value of the diffusion coefficient on which FIG. 3 is based is $2.48e^{-(40,200/RT)}cm^2/sec.$, which is equal to $8.22\times10^{-6}$ $cm^2/sec.$ at 1320° C. Thus the diffusion is exponential in graphitization heating time, and, at higher temperatures, higher loadings and shorter heating times are generally necessary to produce an oriented graphite layer having low rocking angle characteristics.

EXAMPLE 4

In order to investigate the effects of graphitization process conditions on coatings prepared on a nickel substrate near the nickel eutetic temperature, five samples were heat treated for different times in an induction furnace which allowed for a rapid heat-up rate to the reaction (graphitization) temperature range of 1320° to 1325° C. and a rapid cool-down rate. The heat-up time for all five samples was 4.5 minutes and the cool-down rate was exponential with a time constant of 2.25 minutes in each case. The samples were prepared by coating both sides of 0.45 mm thick nickel coupons with colloidal graphite in isopropanol. The re-results of this experiment is shown in Table III, which shows heat treatment times for various weight percent particulate carbon loadings on the metal substrate in the initial coating step, together with a qualitative characterization of the coating achieved thereby.

TABLE III

| Effect of Carbon Loading and Heat Treatment Time at 1320–1325° C. | | | |
|---|---|---|---|
| Sample No. | Wt. % C | Time at 1320–1325° C.(min.) | Results |
| 1 | .72 | 10.5 | Excellent coating. |
| 2 | 1.0 | 4.5 | Unreacted carbon over underlying oriented graphite. |
| 3 | .22 | 5.25 | One-third of surface covered with spotty coating, remainder was bare. |
| 4 | .26 | 1.5 | One-half of surface covered with continuous coating, reminder was bare. |
| 5 | .32 | "0"[a] | One-half of surface covered with continuous coating overlayed with spots of unreacted carbon, remainder was bare. |

[a]Cool down was begun as soon as it was observed that the sample had reached temperature.

The carbon loadings set forth for the various samples in Table III are to be compared with the solubility of carbon in nickel as determined from FIG. 4. FIG. 4 is a graph of the solubility of carbon in nickel with weight percent carbon based on the nickel substrate plotted as a function of temperature. FIG. 4 shows that at a temperature of 1320° C. the solubility of carbon in nickel is approximately 0.49%. At loadings well below the solubility limits represented by the graph in FIG. 4, heat treatment time is particularly important for the development of continuous and well oriented coatings. From the diffusion rate of carbon in nickel, the time for carbon to diffuse half-way into the 0.45 mm thick nickel substrate is calculated to be approximately 1.1 minutes at 1320° C. For samples 3 and 4 in Table III, the heat treatment time exceeds this value and only spotty coatings are obtained. In this case, carbon diffuses so far into the substrate that there is no region in the vicinity of the surface which is saturated with carbon. Such a saturated region is necessary for the precipitation of the oriented graphite layer on the substrate surface. At the other extreme, if the heat treatment period is too brief, as is the case with sample No. 5 in Table III, unreacted carbon will remain on the substrate surface. Unreacted carbon will also remain on the substrate surface if the carbon loading is excessive as is the case with sample No. 2 listed in Table III.

The results of these experiments indicate that it is necessary to maintain a region of saturation in the vicinity of the substrate metal surface in order to precipitate oriented graphite on the surface. In the case of thin substrates for which even short times at heat treatment temperature cause all of the carbon to diffuse into the nickel substrate, this objective may be achieved by loading the sample with an amount of carbon slightly in excess of the solubility limit, as previously discussed. Such is the case for the first sample listed in Table III. With thicker samples for which it may be impractical to apply excess loadings of graphite, the requisite heat treatment time is governed by the amount of carbon present in the initial coating step. The heat treatment time, as previously stated, will be that time which allows the carbon to diffuse into the substrate metal but which is not so long that the substrate becomes unsaturated with respect to the carbon in the vicinity of the surface. It has been experimentally determined that the maximum carbon loadings which give continuous, fully reacted coatings of oriented graphite closely parallel the solubility curve of carbon for the substrate metal, as for example is presented for nickel in FIG. 4.

EXAMPLE 5

An experimental condensation loop was constructed in order to perform long-term performance tests on laboratory samples of the oriented graphite dropwise enhanced condensation surface prepared in accordance with the present invention. A schematic diagram of the apparatus employed in this test is shown in FIG. 5. In this condensation loop, steam was generated in an electrically powered steam generator 60 capable of producing 20 lbs. of steam per hour. Steam from the generator was conducted in line 61 into the lower section 63 of condensation enclosure 62 containing a multitude of ports 64 in which are mounted the heat transfer samples. The steam so introduced to the condensation enclosure traversed the length thereof, passing in turn through the condensation enclosure 64 in which the sample to be evaluated was disposed and thence to upper section 65 from which uncondensed steam was passed in line 66 either to the vent line 73 containing vent control valve means 75 therein or to line 73 communicating with condensor 76. Condensed water formed in the condensation enclosure 62 was drained therefrom by drain means (not shown). The steam condensed in condenser 76 was passed in line 77 into container 78 along with makeup water introduced into the container 78 in line 79. From container 78 water was withdrawn in line 80 and passed to the degassing reservoir 81 in which water was continuously boiled. Boil-off water vapor from the degassing reservoir was condensed in condenser 82 and returned to the reservoir while the uncondensed impurities were vented from the system in line 83. The resultant degassed water from the reservoir 81 was passed in line 84 to demineralizer 85 in which minerals were removed from the water by means of an ion exchange resin. From the demineralizing column the purified water was returned in line 86, having pump means 87 disposed therein, to the steam generating means 60. The condensation loop included a constant temperature reservoir 69 from which water at constant temperature was withdrawn in line 70, having pump means 71 disposed therein, and passed to the water cooled section of the heat transfer cylinders as described below, and thereafter returned in line 72 to the reservoir.

The condensation surfaces evaluated in the FIG. 5 condensation loop were mounted by brazing or soft soldering attachment to the front face of a copper heat transfer cylinder which was water cooled from the rear portion thereof. The copper heat transfer cylinder, which is shown in FIG. 6, consisted of three sections. Grooves 94 and 95 were machined into each of the faces of the center section 92, and 0.25 mm diameter stainless steel sheathed chromel-alumel thermocouples 96 were soldered into these grooves. The three sections of the heat transfer cylinder, the front section 90 with condensing surface 91 mounted thereon, the intermediate section 92, and the rear water-cooled section 93, were soldered together and the entire assembly was mounted in a Tefzel sample holder. The output from each thermocouple in each of the samples under test and in the local steam environment adjacent to the condensing surface were automatically scanned by a digital scanner and printer means 67 coupled to the heat transfer samples by signal transmitting means 68. In this manner, a record of the temperatures and temperature gradient for each sample tested was automatically obtained and recorded during the long-term tests. From the measured temperatures and associated temperature gradient, the heat flux in each case was obtained, and by extrapolating the temperature to the surface of the sample, the surface temperature was obtained. The heat transfer coefficient was then calculated from this data. Table IV lists the samples on which long-term data was taken.

TABLE IV

Heat Transfer Performance of Various Condensing Surfaces For Steam at 100° C. After One Year Continuous Condensing Service

| Sample No. | Description | Heat Transfer Coefficient | Heat Flux | Temperature Difference |
|---|---|---|---|---|
| 1 | Nickel 0.076 mm brazed to copper | .35 | 5.2 | 14.9 |
| 2 | Oriented Graphite produced on 0.076 mm nickel by heat treating in vacuum for 10 minutes at 1232° C. | .54 | 6.4 | 11.8 |
| 3 | Oriented Graphite produced on 0.076 mm nickel by heat treating for 5 hours in argon at 1000° C. | .80 | 6.4 | 8.0 |
| 4 | Oriented Graphite produced on 0.076 mm nickel by heat treating for 15 minutes in argon at 1315° C. | 2.1 | 7.9 | 3.8 |
| 5 | Oriented Graphite produced on 0.076 mm nickel by heat treating for 10 minutes at 1232° C. in vacuum (Sample had many bare patches.) | 2.4 | 7.8 | 3.2 |

The table contains a description of each of the condensing surface samples tested, together with a listing of heat transfer data measured after approximately one year in continuous service. The tabulated heat transfer data includes the calculated heat transfer coefficient in units of calories per centimeter squared per second per degree Kelvin; heat flux in units of calories per centimeter squared per second, and temperature difference between the steam and the condensing surfact in degrees Kelvin. Sample 1 was included in the testing to provide comparative data on a filmwise condensing surface. All of the oriented graphite surfaces prepared in accordance with the method of the present invention remained dropwise in character and there was no observable deterioration in their heat transfer performance over the period of the test. The relatively low heat transfer coefficient measured in Sample 2, along with the associated high value of the temperature difference, was attributed to a poorly brazed joint between the nickel foil coated with oriented graphite and the copper substrate, but even with such deficiencies in the fabrication of the coating surface, the heat transfer coefficient achieved thereby was significantly higher than that obtained with the filmwise nickel-copper surface of Sample No. 1. The heat transfer performance of Sample No. 3 was somewhat poorer than might be expected from a dropwise condensing surface due to the presence of a large void in the soft soldered joint between the front and center sections of the copper heat transfer cylinder. Nonetheless, the heat transfer coefficient of Sample No. 3 was still twice that of the filmwise condensing copper-nickel surface. The heat transfer performance of Samples 4 and 5 are more typical of dropwise condensation. The observed performance of Sample No. 5 was particularly interesting inasmuch as that sample visibly appeared to have a poor coating characterized by many bare patches. The bare patches were comparatively extensive and because of this the sample had a mottled appearance over approximately one-third of its area. Despite this fact, the heat transfer performance on the surface was excellent. It is possible that the bare nickel spots on the surface may have acted as particularly effective drop nucleation sites. Indeed, it was observed that drops repeatedly formed on the same bare patches. Thus, such surface, characterized by the presence of bare hydrophilic areas lying in an otherwise hydrophobic surface, may advantageously be employed under the broad practice of the present invention. Such a surface may suitably be prepared by loading discrete spaced apart areas with particulate carbon in the initial coating step, or alternatively, by scoring portions of the oriented graphite surface after a uniform coating has been formed on the substrate metal.

EXAMPLE 6

In this Example, condensation heat transfer measurements were performed on an oriented graphite coating prepared according to the invention. These measurements were carried out in a condensing environment containing varying amounts of noncondensable vapors.

Figure 7:
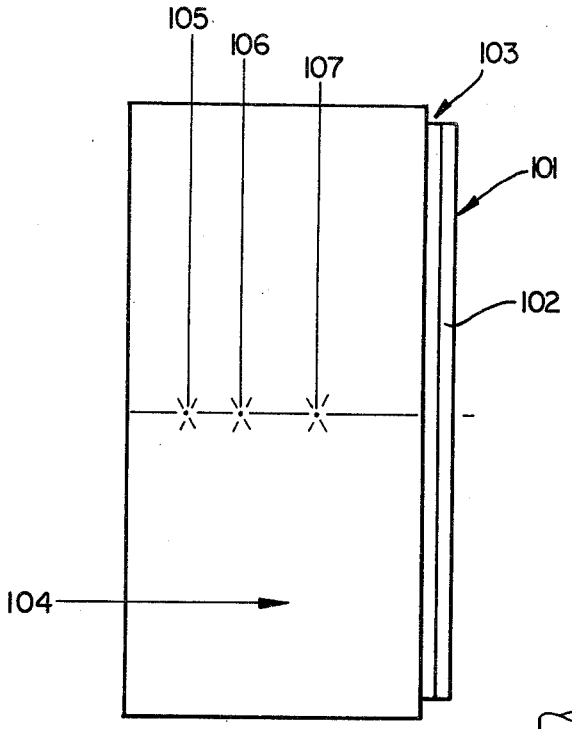
FIG. 7 is a cross-sectional view in elevation of a heat transfer cylinder used to test the condensing heat transfer performance of oriented graphite coatings in atmospheres containing varying amounts of noncondensable components.

The sample consisted of a nickel sheet coated on one side with an oriented graphite coating prepared in accordance with the present invention and soft soldered on the other side to a face of cylindrical copper block in which were located three thermocouples at different positions along its axis. The sample is shown in FIG. 7. An oriented graphite coating 101 was formed on an underlying 0.45 mm thick nickel sheet 102 in the following manner. A nickel strip was first cleaned with abrasive paper and subsequently degreased in trichloroethylene. A suspension of colloidal carbon in isopropanol was applied to both sides of the nickel strip and dried at 100° C. for 10 minutes so as to provide a coating of unoriented carbon which weighed 1.1 percent of the weight of the nickel strip. The coated nickel strip was then heated in flowing argon from ambient temperature to a temperature of 1325° C. and kept at that temperature for thirty minutes before being cooled with the resultant formation of highly oriented graphite coatings on both surfaces of the nickel strip. The oriented graphite was abraded from one side of the nickel strip and a disk 2.4 cm in diameter was punched from the strip. This disk was bonded with soft solder 103 to one face of a cylindrical copper block 104 which was 1.27 long and 2.5 cm in diameter. Stainless steel sheathed chromel-alumel thermocouple elements with an outside diameter of 0.25 mm were mounted at positions 105, 106 and 107 along the axis of the copper cylinder in order to facilitate both the determination of the heat flux through the block during the condensation of steam on the graphite surface and also the temperature of the graphite surface during condensation.

Figure 8:
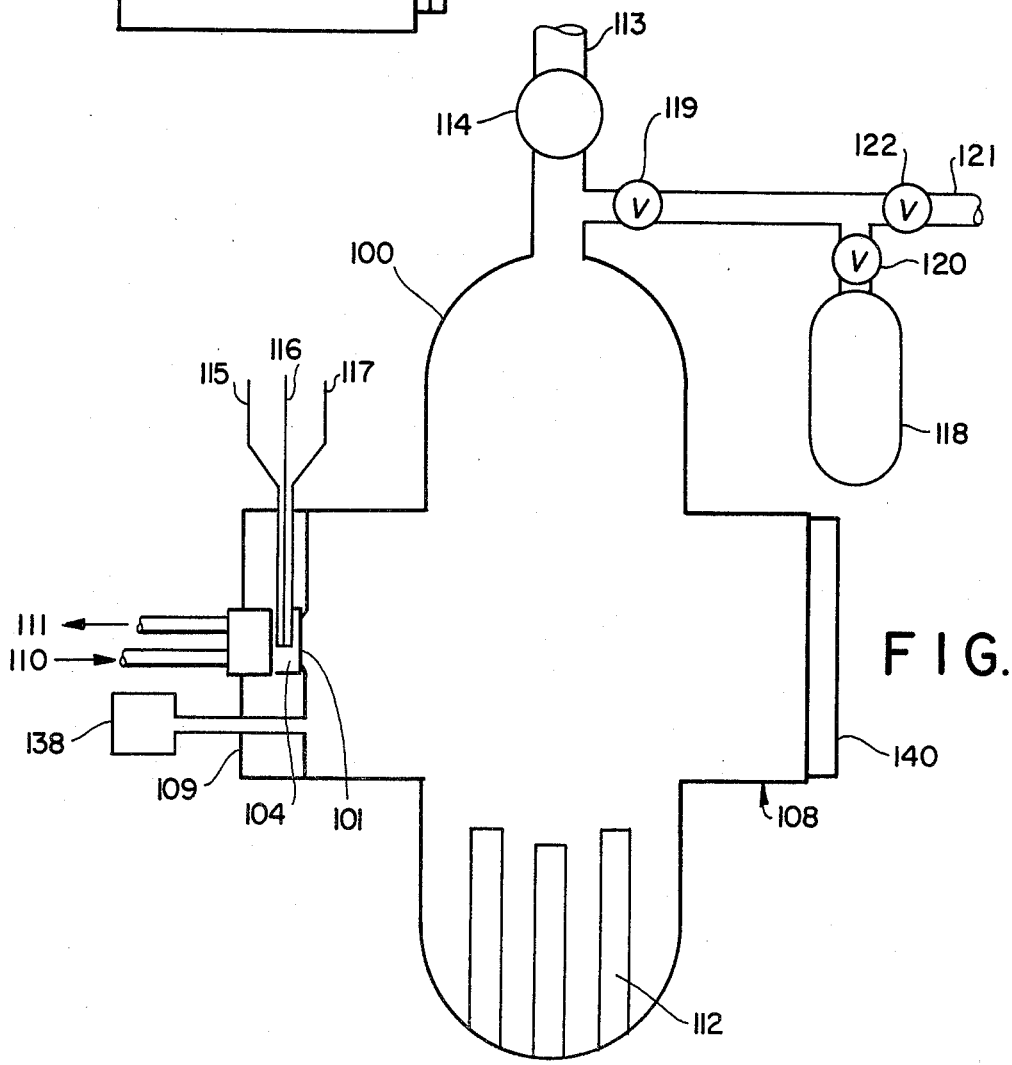
FIG. 8 is a schematic diagram of apparatus in which the FIG. 7 cylinder was disposed for the condensing heat transfer tests.

The above-described sample was mounted in test enclosure 100 of the FIG. 8 test apparatus 108 in a polytetrafluorethylene sample holder 109 through which the rear of the copper cylinder was exposed to flowing cooling water by means of lines 110 and 111. Water was added to cover the electrical heaters 112 and the entire apparatus was degassed through vacuum line 113 and valve 114 after which valve 114 was closed isolating the system from the vacuum. Vacuum pressure in the enclosure 100 was monitored during the test by means of pressure transducer 138. Steam was generated by applying electrical power to the electrical heaters 112, and this steam condensed in a dropwise manner on the face of the sample causing a flow of heat through the copper cylinder 104 and a temperature gradient which was measured by thermocouples 115, 116 and 117. From the measured gradient, the heat flux and condensing surface temperature were determined. The steam temperature was monitored by a thermocouple placed in front of the condensing surface, and from these data heat transfer coefficients were calculated. During the test, the condensation performance of the sample was observed visually through viewing window 140. By varying the temperature and flow rate of the cooling water to the rear of the sample, heat transfer measurements were made at various condensation surface temperatures and heat fluxes.

Samples of steam were periodically taken by means of sample bulb 118 through valves 119 and 120 after the first evacuating sample bulb 118 through line 121 and valve 122. The level of noncondensable vapor components was determined by measuring the residual pressure in bulb 118 after one end of it had been immersed in a mixture of dry ice and acetone so as to freeze the steam and reduce its vapor pressure to a negligible level.

Figure 9:
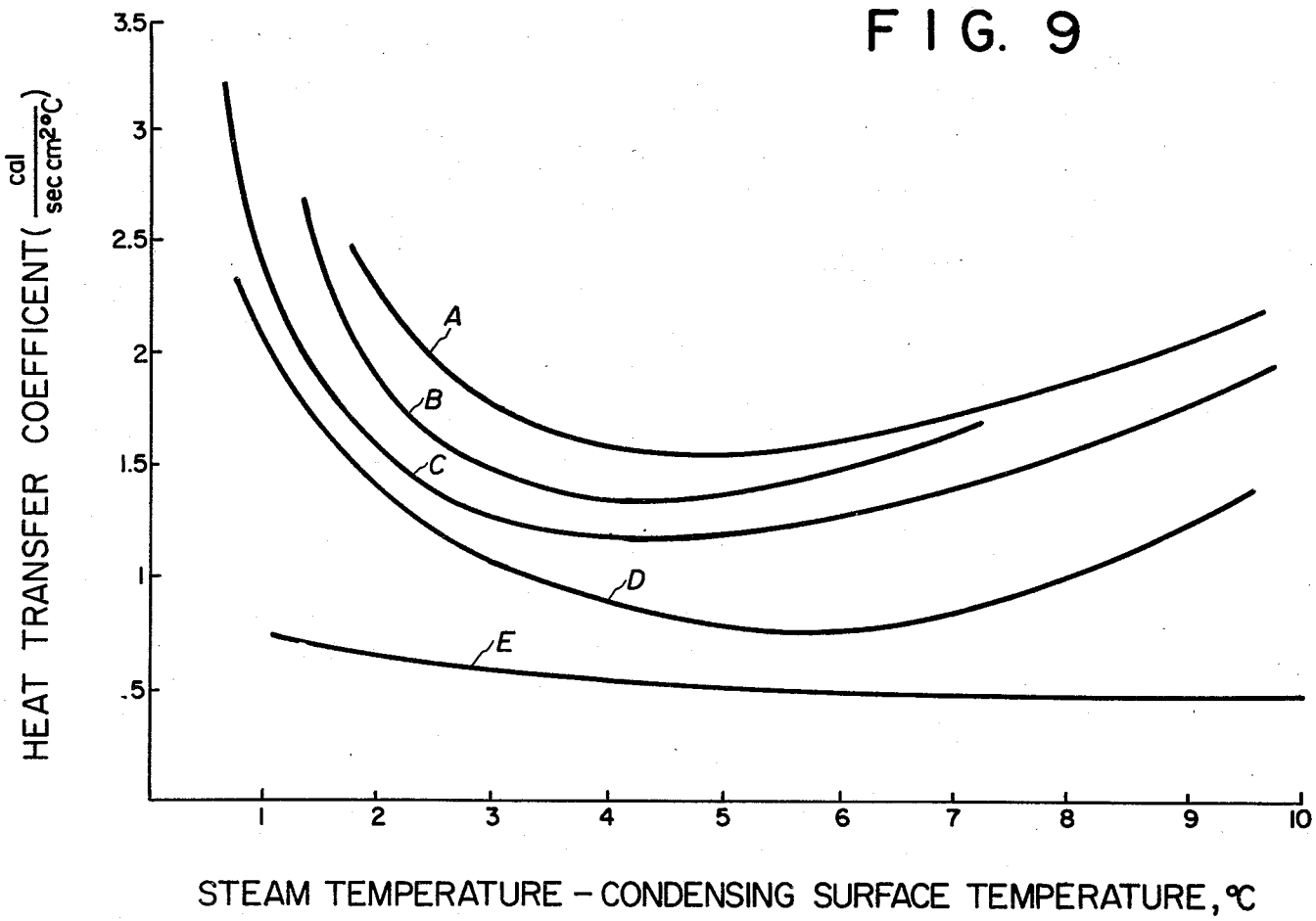
FIG. 9 is a graph of the heat transfer coefficient of the condensing surface as a function of the condensing surface subcooling temperature gradient, for oriented graphite films in atmospheres containing varying amounts of non-condensable components.

Results of heat transfer coefficient determination as based on measurement with steam at 100° C. are shown in FIG. 9 for four different volume fractions of noncondensable vapors in the steam: Curve A=48 parts-per-million (ppm) noncondensables; Curve B=28 ppm noncondensables; Curve C=290 ppm noncondensables; and Curve D=5000 ppm noncondensables. Also shown is the value for the laminar filmwise condensation heat transfer coefficient by Curve E. As shown by the FIG. 9 graph, in the presence of less than 300 parts per million by volume of noncondensable vapors in the steam, an enhancement in the heat transfer rate of three to four times the filmwise value is indicated. Even in the presence of 5000 parts per million by volume of noncondensables, significant improvements in the heat transfer rate are achieved compared to the laminar filmwise heat transfer rate.

EXAMPLE 7

In this Example, a copper base metal tube with an oriented graphite coating on its outer surface was prepared in accordance with the present invention, and the heat transfer rates for steam condensing on such a tube were measured and compared to the heat transfer rates for steam condensing on an uncoated tube of bare copper.

A strip of nickel 5 cm wide, 0.0075 cm thick and 90 cm long was coated on one side with an excess of carbon suspended in isopropanol. The isopropanol was allowed to evaporate, and the coated nickel strip was heated to 1125° C. in an argon atmosphere. The nickel strip with its carbon coating was maintained at that temperature for a period of one hour before being cooled to room temperature. A highly oriented graphite coating was thus formed on the surface opposite that which was originally coated with an excess of unoriented carbon. The excess carbon remaining on the initially coated surface was removed and that surface of the strip was tinned with a 50-50 tin-lead solder alloy. A copper tube of 2.86 cm outside diameter, 1.76 cm inside diameter and 37.5 cm long was tinned on its outer surface with a 50-50 tin-lead solder alloy. The tube was heated so as to melt the solder, and the graphite coated nickel foil was spirally wrapped around the outside surface of the tube while being kept under tension so that the tinned surfaces of both the nickel strip and the copper tube were in intimate contact with one another. The tube was then cooled to solidify the solder, and a copper base metal tube with an oriented graphite external dropwise condensing surface was thereby produced. At each end of the tube, two thermocouples were mounted in its wall diametrically opposite each other so as to facilitate the determination of the heat flux produced by condensing steam on the outside of the tube.

Figure 10:
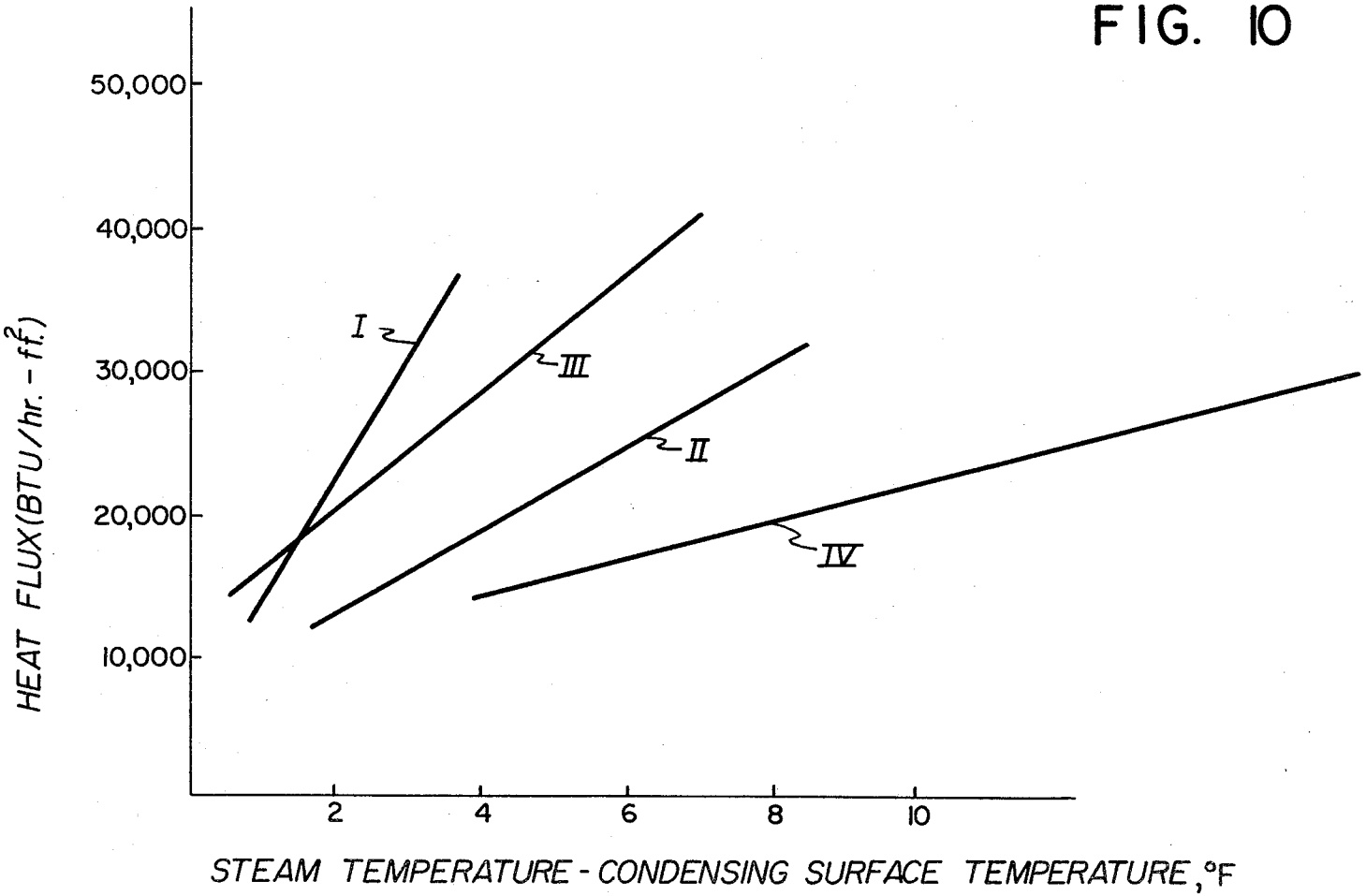
FIG. 10 is a graph of heat flux for steam condensation as a function of temperature difference between the steam and condensing surface, for horizontally and vertically oriented heat exchange tubes with bare condensing surfaces and with oriented graphite films coated thereon.

The tube was equipped with fittings so that cooling water could be made to flow through the inside of the tube, and the tube was mounted within a cylindrical enclosure through which steam was made to flow around the tube at a pressure of between 1.3 and 1.7 atmospheres. The apparatus was adapted for mounting of the tube either vertically or horizontally. It was observed that the steam condensed on the outside of the tube in a dropwise manner and FIG. 1 shows the heat flux as a function of the temperature difference between the steam and the condensing surface for both a horizontally (Curve I) and a vertically (Curve III) mounted tube coated with oriented graphite. Also shown in FIG. 10 is the heat transfer behavior determined in the same apparatus for a horizontal (Curve II) and vertical (Curve IV) bare copper tube upon which steam condensed in a filmwise manner. It can be seen that improvements in the heat transfer by a factor of 2 to 4 were achieved by the copper tube with an oriented graphite condensing surface as compared to the behavior of a bare copper tube.

Although preferred embodiments of the present invention have been described in detail, it will be appreciated that other embodiments are contemplated only with modification of the disclosed features, as being within the scope of the invention. For example, although the preceding description has been directed to the utilization of an oriented graphite surface as an enhanced surface for condensation heat transfer, the oriented graphite layer and coating of this invention may be useful in other applications, as for example as a low friction bearing surface.

What is claimed is:

1. A method of forming an oriented graphite coating on a metallic substrate comprising the steps of:

(a) forming said metallic substrate by covering a copper or copper alloy base member with a continuous layer of nickel, nickel alloy, cobalt or cobalt alloy;

(b) providing a substantially uniform coating of particulate carbon on the metallic substrate;

(c) heating the coated metallic substrate in a nonreactive atmosphere to a temperature of between 800° C. and 1350° C. and below the melting point of said metallic substrate and maintaining said temperature for a period of time sufficient for saturational diffusion of said carbon into said substrate; and (d) thereafter cooling the metallic substrate to a temperature below about 200° C., thereby providing a precipitated oriented graphite film at a surface of said substrate.

2. A method according to claim 1 comprising forming said continuous layer by bonding a foil of nickel, nickel alloy, cobalt or cobalt alloy to said base member.

3. A method according to claim 1 comprising forming said continuous layer by electroplating nickel or cobalt on said base member.

4. A method according to claim 1 comprising forming said continuous layer by vapor deposition of nickel or cobalt on said base member.

5. A method according to claim 1 comprising forming said continuous layer of nickel, nickel alloy, cobalt or cobalt alloy at a thickness of between 0.025 and 1.0 mm.

6. A method of forming an oriented graphite coating on a metal base material tube comprising the steps of:

(a) providing a substantially uniform coating of particulate carbon on one side of a thin metal foil;

(b) heating the coated metal foil in a nonreactive atmosphere to a temperature of between 800° C. and 1350° C. and below the melting point of said metal foil, and maintaining said temperature for a period of time sufficient for saturational diffusion of said carbon through said metal foil from said one side to the other side thereof;

(c) thereafter cooling the metal foil to a temperature below about 200° C., thereby providing a precipitated oriented graphite film at said other side of said metal foil; and (d) bonding said metal foil one side to the outer surface of said metal base material tube and in thermal contact therewith.

7. A method according to claim 6 wherein said metal foil is in the form of an extended strip and said metal base material tube is wrapped with said metal foil extended strip for said bonding of said metal foil to said tube.

8. A method according to claim 7 wherein said metal base material tube is helically wrapped with said metal foil extended strip to provide a circumferentially and longitudinally extending continuous layer of said precipitated oriented graphite film on said tube.

9. A method according to claim 6 wherein said metal foil is bonded to said tube with a thermally conductive bonding medium.

10. A method according to claim 9 wherein said bonding medium comprises a metal or metal alloy having a melting point below 1000° C. and the melting point of said metal base material of said tube and of said metal foil, and wherein said metal foil one side and said tube outer surface are adjacently aligned with said bonding medium disposed therebetween and said tube is heated to a temperature sufficient to melt said bonding medium and thereafter cooled to a temperature below the melting point of said bonding medium for said bonding of said metal foil to said metal base material tube outer surface.

* * * * *